US009044064B2

(12) United States Patent
Baucom et al.

(10) Patent No.: US 9,044,064 B2
(45) Date of Patent: Jun. 2, 2015

(54) ARTICLE OF FOOTWEAR HAVING A SOLE STRUCTURE WITH HEEL-ARCH STABILITY

(75) Inventors: Jim Baucom, Portland, OR (US); David J. Dirsa, North Andover, MA (US); Clifford B. Gerber, West Linn, OR (US); Joseph Howley, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 449 days.

(21) Appl. No.: 13/492,350

(22) Filed: Jun. 8, 2012

(65) Prior Publication Data

US 2013/0326911 A1 Dec. 12, 2013

(51) Int. Cl.

| | |
|---|---|
| ***A43B 5/02*** | (2006.01) |
| ***A43B 13/12*** | (2006.01) |
| ***A43B 13/42*** | (2006.01) |
| ***A43B 13/26*** | (2006.01) |
| ***A43B 23/22*** | (2006.01) |

(52) U.S. Cl.

CPC ..... *A43B 13/122* (2013.01); *A43B 13/42* (2013.01); *A43B 5/02* (2013.01); *A43B 13/26* (2013.01); *A43B 23/222* (2013.01)

(58) Field of Classification Search

CPC ..... A43B 5/02; A43B 13/122; A43B 23/227; A43B 13/10; A43B 13/22–13/26; A43B 13/41; A43B 13/42; A43C 15/16; A43C 15/161; A43C 15/167

USPC ..... 36/103, 128, 148, 149, 67 R, 76 R, 59 C, 36/107, 108, 134, 67 A

See application file for complete search history.

(56) References Cited

U.S. PATENT DOCUMENTS

| | | | | | |
|---|---|---|---|---|---|
| 372,561 | A | * | 11/1887 | Paris | 36/150 |
| 1,823,445 | A | | 9/1931 | Goldstone | |
| 1,879,729 | A | * | 9/1932 | Brown et al. | 36/155 |
| 2,455,500 | A | | 12/1948 | Knellwolf | |
| 2,683,317 | A | * | 7/1954 | Sprigg | 36/32 R |
| 3,328,901 | A | * | 7/1967 | Strickland | 36/59 R |
| 4,026,045 | A | | 5/1977 | Druss | |
| 4,199,878 | A | | 4/1980 | Wossner | |
| D272,772 | S | * | 2/1984 | Kohno | D2/954 |
| 4,430,810 | A | | 2/1984 | Bente | |
| 4,573,279 | A | | 3/1986 | Feurer-Zogel et al. | |
| 4,858,343 | A | | 8/1989 | Flemming | |
| 4,922,631 | A | | 5/1990 | Anderie | |
| 5,452,526 | A | | 9/1995 | Collins | |
| 5,461,801 | A | * | 10/1995 | Anderton | 36/114 |

(Continued)

FOREIGN PATENT DOCUMENTS

| | | |
|---|---|---|
| GB | 2256784 | 12/1992 |

*Primary Examiner* — Ted Kavanaugh
(74) *Attorney, Agent, or Firm* — Plumsea Law Group, LLC

(57) ABSTRACT

An article of footwear may include an upper and a sole structure secured to the upper. The sole structure may include an outsole including ground engaging members and a reinforcement member. The reinforcement member may extend between (1) a first mounting member located in a forefoot region of the outsole and configured to connect the reinforcement member to the outsole, and (2) a second mounting member located in a heel region of the outsole and configured to connect the reinforcement member to the outsole. The first mounting member may be located adjacent to a ground engaging member in the forefoot region of the outsole and the second mounting member is located adjacent to a ground engaging member in the heel region of the outsole.

24 Claims, 10 Drawing Sheets

(56) References Cited

U.S. PATENT DOCUMENTS

| | | | | |
|---|---|---|---|---|
| 5,555,650 | A * | 9/1996 | Longbottom et al. | 36/114 |
| 5,778,560 | A | 7/1998 | Danieli | |
| 6,708,427 | B2 | 3/2004 | Sussmann et al. | |
| 6,807,753 | B2 | 10/2004 | Steszyn et al. | |
| 6,968,637 | B1 | 11/2005 | Johnson | |
| 6,983,553 | B2 | 1/2006 | Lussier et al. | |
| 7,143,530 | B2 * | 12/2006 | Hudson et al. | 36/128 |
| 7,188,439 | B2 | 3/2007 | DiBenedetto et al. | |
| 7,225,565 | B2 | 6/2007 | DiBenedetto et al. | |
| 7,263,788 | B2 | 9/2007 | Johnson | |
| 7,337,562 | B2 | 3/2008 | Kim | |
| 7,421,805 | B2 | 9/2008 | Geer | |
| 7,503,132 | B2 | 3/2009 | Mason | |
| 7,506,460 | B2 | 3/2009 | DiBenedetto et al. | |
| 7,594,345 | B2 | 9/2009 | Fusco | |
| 7,631,382 | B2 | 12/2009 | DiBenedetto et al. | |
| 7,676,960 | B2 | 3/2010 | DiBenedetto et al. | |
| 7,676,961 | B2 | 3/2010 | DiBenedetto et al. | |
| 2005/0241187 | A1 | 11/2005 | Johnson | |
| 2005/0268489 | A1 | 12/2005 | Austin | |
| 2007/0079530 | A1 | 4/2007 | Fusco | |
| 2009/0056166 | A1 | 3/2009 | Edy et al. | |
| 2009/0100716 | A1 * | 4/2009 | Gerber | 36/114 |
| 2010/0122472 | A1 | 5/2010 | Wilson, III et al. | |
| 2010/0154258 | A1 | 6/2010 | Scholz et al. | |
| 2011/0047816 | A1 | 3/2011 | Nurse | |
| 2012/0279091 | A1 * | 11/2012 | Baucom et al. | 36/67 A |
| 2013/0067777 | A1 * | 3/2013 | Minami | 36/59 R |

* cited by examiner

ARTICLE OF FOOTWEAR HAVING A SOLE STRUCTURE WITH HEEL-ARCH STABILITY

BACKGROUND

Conventional articles of athletic footwear include two primary elements, an upper and a sole structure. The upper provides a covering for the foot which comfortably receives and securely positions the foot with respect to the sole structure. The sole structure is secured to a lower portion of the upper and is generally located between the foot and the ground. In addition to attenuating ground reaction forces (i.e., providing cushioning) during walking, running, and other ambulatory activities, the sole structure may influence foot motions (e.g., by resisting pronation), impart stability, and provide traction, for example. Accordingly, the upper and the sole structure operate cooperatively to provide a comfortable structure that is suited for a wide variety of athletic activities.

The sole structure may generally incorporate multiple layers: a sockliner, a midsole, and an outsole. The sockliner can be a thin, compressible member located within the upper and adjacent to a plantar (i.e., lower) surface of the foot to enhance footwear comfort. The midsole can be secured to a lower surface of the upper and can form a middle layer of the sole structure. Many midsole configurations are primarily formed from a resilient polymer foam material, such as polyurethane or ethylvinylacetate, which extends throughout the length and width of the footwear. The midsole may also incorporate fluid-filled chambers, plates, moderators, or other elements that further attenuate forces, influence the motions of the foot, or impart stability, for example. The outsole forms the ground-contacting element of the footwear and may be produced from a durable and wear-resistant material (e.g., rubber) that includes texturing to improve traction.

The materials of the sole structure are generally flexible materials that bend and deform when subjected to a load, such as when a wearer of the article of footwear takes a step and/or when the wearer pivots on the forefoot of the footwear. During such motions the various regions of the sole structure, such as the forefoot, midfoot or arch, and heel regions, can flex and bend. However, these various regions of the sole structure may flex or bend to different degrees, which may result from different forces applied to the various regions, varying degrees of flexibility for each region, and/or other factors.

SUMMARY

Various aspects of an article of footwear and a sole structure for an article of footwear are disclosed below.

In general, an article of footwear may include an upper and a sole structure secured to the upper. The sole structure may include an outsole including ground engaging members and a reinforcement member. The reinforcement member may extend between a first mounting member that is located in a forefoot region of the outsole and is configured to connect the reinforcement member to the outsole, and a second mounting member which is located in a heel region of the outsole and is configured to connect the reinforcement member to the outsole. The first mounting member may be located adjacent to a ground engaging member in the forefoot region of the outsole and the second mounting member is located adjacent to a ground engaging member in the heel region of the outsole.

According to an embodiment, an article of footwear may include an upper and a sole structure secured to the upper. The sole structure may include an outsole including ground engaging members. The sole structure may further include two reinforcement members, with each reinforcement member having a forward end and a rearward end. The two reinforcement members may extend between ground engaging members located in a forefoot region of the sole structure and a heel region of the sole structure. The forward ends of the two reinforcement members may be located adjacent to separate ground engaging members in the forefoot region of the sole structure and the rearward ends of the two reinforcement members are located adjacent to a same ground engaging member in the heel region of the sole structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

The following discussion and accompanying figures disclose an article of footwear having an upper and a sole structure. The article of footwear is disclosed as having a general configuration of a cleat, which can be used for various sports activities, such as, for example, baseball, soccer, football, rugby, and other sports activities. It should be noted that the embodiments described herein could also be applied to other articles of footwear having cleats or other traction elements, such as, for example, hiking boots and other types of footwear.

For consistency and convenience, directional adjectives may be employed throughout this detailed description corresponding to the illustrated embodiments. The term "longitudinal" as used throughout this detailed description and in the claims refers to a direction extending a length of a sole structure. In some embodiments, the longitudinal direction may extend from a forefoot region to a heel region of the sole. Also, the term "lateral" as used throughout this detailed description and in the claims refers to a direction extending a width of a sole. In other words, the lateral direction may extend between a medial side and a lateral side of a sole. Furthermore, the term "vertical" as used throughout this detailed description and in the claims refers to a direction generally perpendicular to a lateral and longitudinal direction. For example, in embodiments where a sole is planted flat on a ground surface, the vertical direction may extend from the ground surface upward. It will be understood that each of these directional adjectives may be applied to individual components of a sole.

Figure 1:
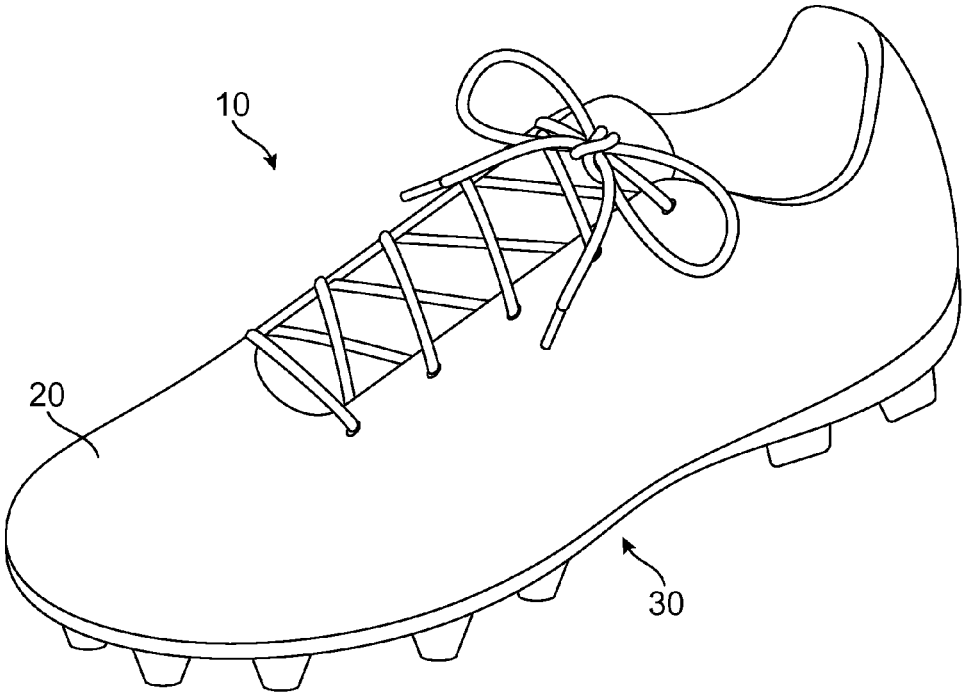
FIG. 1 is an isometric view of an embodiment of an article of footwear.

FIG. 1 illustrates an isometric view of an embodiment of an article of footwear 10. Article of footwear 10 may include an upper 20 and a sole structure 30. Upper 20 can be formed, for example, from a plurality of material elements (e.g., textiles, polymer sheets, foam layers, leather, synthetic leather) that are stitched or adhesively bonded together to form a void on the interior of the article of footwear 10 for comfortably and securely receiving a foot. More particularly, upper 20 can form a structure that extends over instep and toe areas of the foot, along medial and lateral sides of the foot, and around a heel area of the foot. Upper 20 may also incorporate a lacing system to adjust fit of the footwear, as well as permitting entry and removal of the foot from the void within upper 20. In addition, upper 20 may include a tongue that extends under the lacing system to enhance adjustability and comfort of the footwear. In some embodiments, upper 20 may incorporate a heel counter.

In some embodiments, sole structure 30 may be configured to provide traction for an article of footwear 10. In addition to providing traction, sole structure 30 may attenuate ground reaction forces when compressed between the foot and the ground during walking, running or other ambulatory activities. The configuration of sole structure 30 may vary significantly in different embodiments to include a variety of conventional or non-conventional structures. In some embodiments, the configuration of sole structure 30 can be configured according to one or more types of ground surfaces on which sole structure 30 may be used. Examples of ground surfaces include, but are not limited to: natural turf, synthetic turf, dirt, as well as other surfaces.

For purposes of clarity, sole structure 30 is shown in isolation from other components of article of footwear 10 in FIGS. 2 through 10 to provide further details of the sole structure 30. It should be understood, however, that other embodiments could incorporate any other kind of upper as well as additional footwear components.

Figure 2:
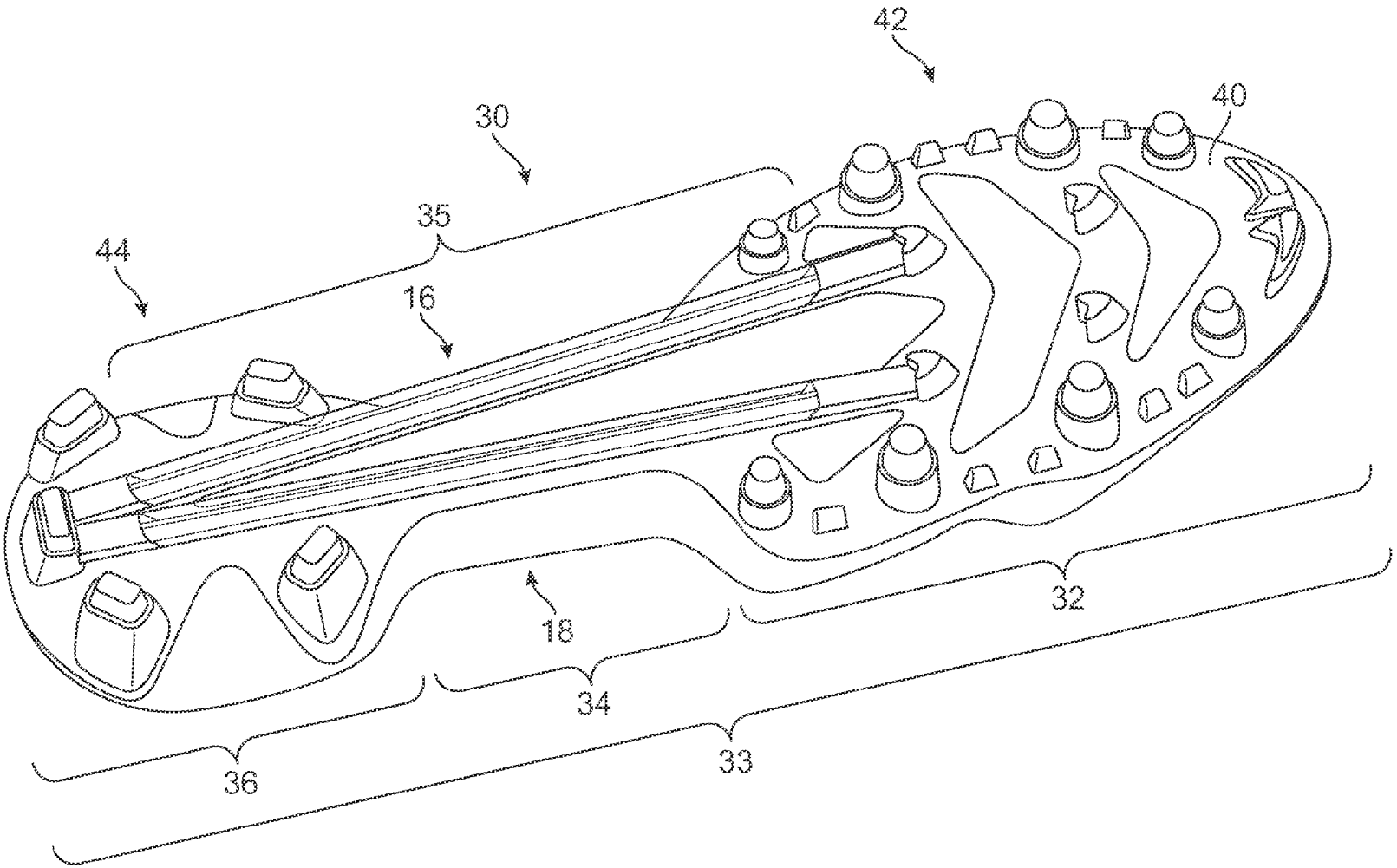
FIG. 2 is an isometric view of an embodiment of an article of footwear, which is arranged so that the sole structure is facing upwards.

FIG. 2 illustrates an isometric view of a bottom side of sole structure 30. For reference purposes, sole structure 30 may be divided, for example, into three general regions: a forefoot region 32, a midfoot region 34, and a heel region 36. Forefoot region 32 generally includes portions of sole structure 30 corresponding with the toes and the joints connecting the metatarsals with the phalanges. Midfoot region 34 generally includes portions of sole structure 30 corresponding with an arch area of the foot. Heel region 36 generally corresponds with rear portions of the foot, including the calcaneus bone. In addition, for purposes of reference, medial side 16 and lateral side 18 may be used to generally describe two opposing sides of sole structure 30. With reference to FIG. 2, it will be understood that forefoot region 32, midfoot region 34, and heel region 36 are only intended for purposes of description and are not necessarily intended to demarcate precise regions of sole structure 30. Although an article of footwear for a left foot is depicted in the drawings, it will be understood that the embodiments described herein are applicable to articles of footwear for left and right feet.

The example of FIG. 2 shows a bottom view of an article of footwear 10 so that sole structure 30 is facing upwards and is more exposed. In some embodiments, sole structure 30 can include an outsole 40, which can include a ground-contacting portion of article of footwear 10. In some embodiments, outsole 40 may be produced from a durable and wear-resistant material (for example, rubber) that includes texturing to improve traction.

In some embodiments, outsole 40 can include ground engaging members to enhance traction between outsole 40 and a ground surface. The ground engaging members can be provided in the form of protuberances which project in a direction substantially extending from an outer surface of outsole 40 to a ground surface. A ground engaging member can be, for example, in the form of a cleat, which can be provided in various sizes and geometries.

Some embodiments of a sole structure 30 may include ground engaging members having different locations and/or sizes. For example, sole structure 30 can include a first group 42 of ground engaging members arranged in the forefoot region 32 of sole structure 30. Sole structure 30 may also include a second group 44 of ground engaging members arranged in the heel region 36 of sole structure 30.

Figure 3:
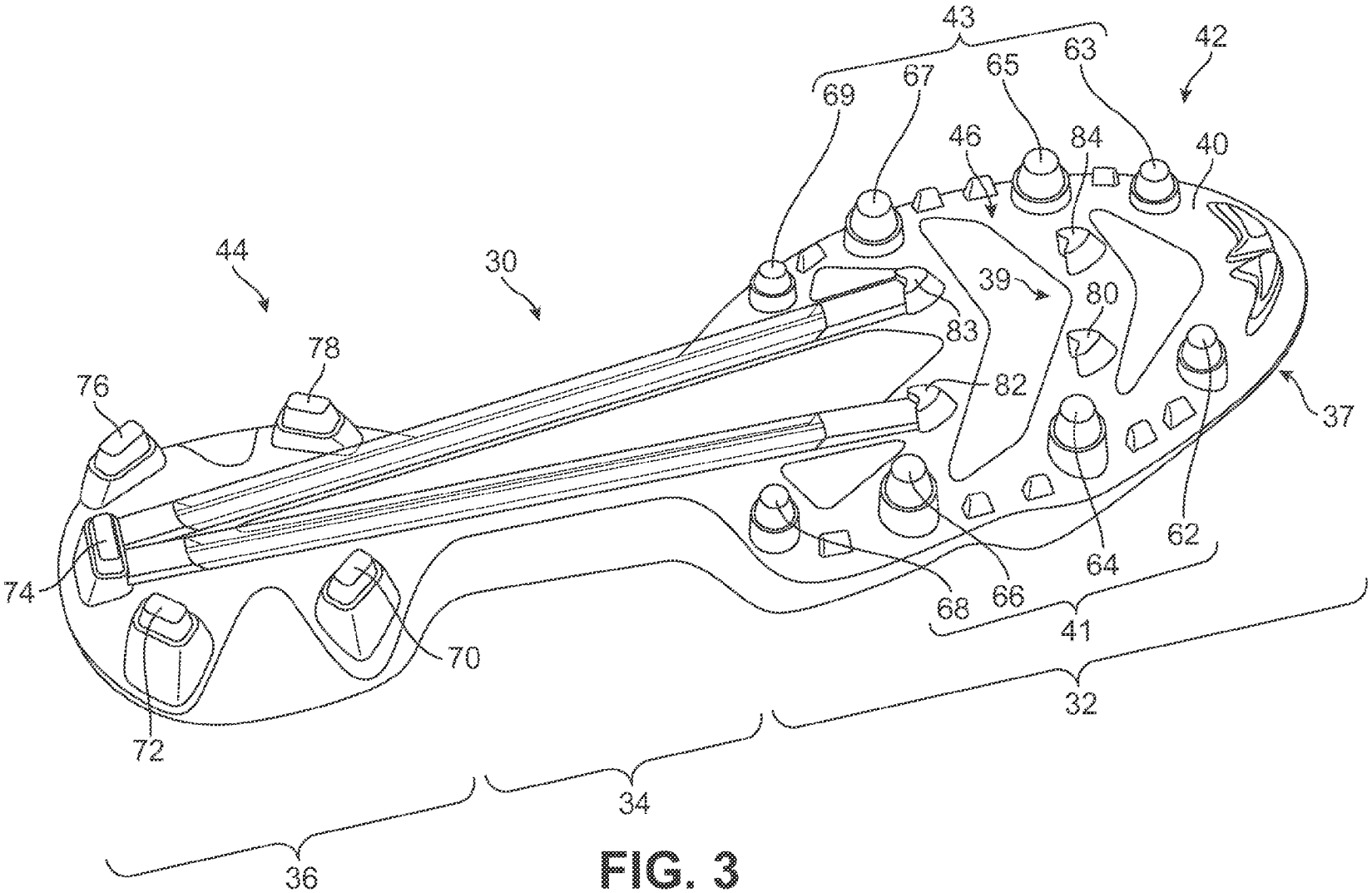
FIG. 3 is an isometric view of the embodiment of FIG. 2.

The details of the ground engaging members introduced in the embodiment of FIG. 2 now are discussed in further detail with reference to FIG. 3. As seen in FIG. 3, first group 42 of ground engaging members can include a forward lateral ground engaging member 62, a forward medial ground engaging member 63, a forward intermediate lateral ground engaging member 64, a forward intermediate medial ground engaging member 65, a rear intermediate lateral ground engaging member 66, a rear intermediate medial ground engaging member 67, a rear lateral ground engaging member 68, and a rear medial ground engaging member 69. In another example, the second group 44 of ground engaging members can include a forward lateral ground engaging member 70, a rear lateral ground engaging member 72, a rear ground engaging member 74, a rear medial ground engaging member 76, and a forward medial ground engaging member 78.

For purposes of convenience, such ground engaging members can be further subgrouped. For example, forward lateral ground engaging member 62, forward intermediate lateral ground engaging member 64, rear intermediate lateral ground engaging member 66 and a rear lateral ground engaging member 68 may be collectively referred to as subgroup 41. Also, forward medial ground engaging member 63, forward intermediate medial ground engaging member 65, rear intermediate medial ground engaging member 67 and rear medial ground engaging member 69 may be collectively referred to as subgroup 43.

The ground engaging members can be provided in various numbers and can have various geometries besides those examples depicted in the drawings. Further, in some embodiments, the ground engaging members may be securely fastened to the outsole 40 so that the ground engaging members are not readily removable by a user. In other embodiments, the ground engaging members may be configured to be removed by a user and interchanged with other ground engaging members. As one example, interchangeable ground engaging members could allow a user to switch the size and/or geometry of a ground engaging member.

In some embodiments, additional ground engaging members can be provided in the sole structure 30. In some embodiments, additional cleats can be included to further enhance the traction between the outsole 40 and a ground surface. For example, in some embodiments, outsole 40 can further include a third group 46 of ground engaging members, such as when additional traction with a ground surface is desired. In one embodiment, third group 46 may comprise first inner forefoot ground engaging member 80, second inner forefoot ground engaging member 82, third inner forefoot ground engaging member 83 and fourth inner forefoot ground engaging member 84.

Groups of ground engaging members can be arranged in various configurations, such as according to a desired use of the article of footwear. In some embodiments, the ground engaging members of the first group 42 and second group 44 may differ from the ground engaging members of third group 46, such as to provide a different form of traction for the forefoot region 32 and the heel region 36 of the sole structure 30. In some embodiments, for example, the ground engaging members of first group 42 and second group 44 may be disposed in a peripheral portion 37 of outsole 40, while the ground engaging members of the third group 46 may be disposed within an interior portion 39 of outsole 40. In particular, interior portion 39 may be disposed inwardly from peripheral portion 37, as depicted in the example in FIG. 3. With this arrangement, first group 42 and second group 44 of ground engaging members may help control traction along the edges of outsole 40, which may be especially useful in controlling cutting and lateral movements. Additionally, third group 46 of ground engaging members may help control traction within interior portion 39 of forefoot region 32, which may be especially useful for controlling traction during planting or launching.

In some embodiments, the ground engaging members of the third group 46 may differ from those of the first 42 and second 44 groups by having, for example, a different size and/or shape to provide a different form of traction for the interior portion 39 of outsole 40. For example, the ground engaging members of third group 46 may be smaller than those of first group 42 and second group 44. Additionally, in some embodiments, the ground engaging members of third group 46 may protrude less in a direction projecting vertically downwards from an outer surface of outsole 40 than those of first group 42 and second group 44. In other words, in some embodiments, the average height of ground engaging members of third group 46 may be substantially less than the corresponding average height of ground engaging members in first group 42 and second group 44. In this manner, the ground engaging members of third group 46 could be classified as minor ground engaging members due to their relatively smaller sizes and/or shapes while the ground engaging members of first group 42 and second group 44 could be classified as major ground engaging members due to their relatively larger sizes and/or shapes. For example, a minor ground engaging member can be smaller in size and/or shape than a major ground engaging member. The ground engaging members of first group 42 and second group 44 may also differ from one another as well, such as by location, size, and/or shape.

Some embodiments can include provisions for reinforcing one or more portions of the sole structure to enhance the stiffness and/or stability of the sole structure. In some embodiments, for example, a sole structure could include one or more reinforcement members that help enhance stiffness and reduce torsion at predetermined portions of the sole structure.

Sole structure 30 can include various numbers and configurations of reinforcement members to enhance the stiffness and/or stability of sole structure 30. According to one embodiment, sole structure 30 can include a single reinforcement member. According to another embodiment, sole structure 30 can include two reinforcement members, such as first reinforcement member 50 and second reinforcement member 52 shown in FIG. 4. In still other embodiments, sole structure 30 could incorporate three or more reinforcement members. The number of reinforcement member(s) can be selected, for example, in accordance with a desired amount of stiffness and/or stability to be provided.

Figure 4:
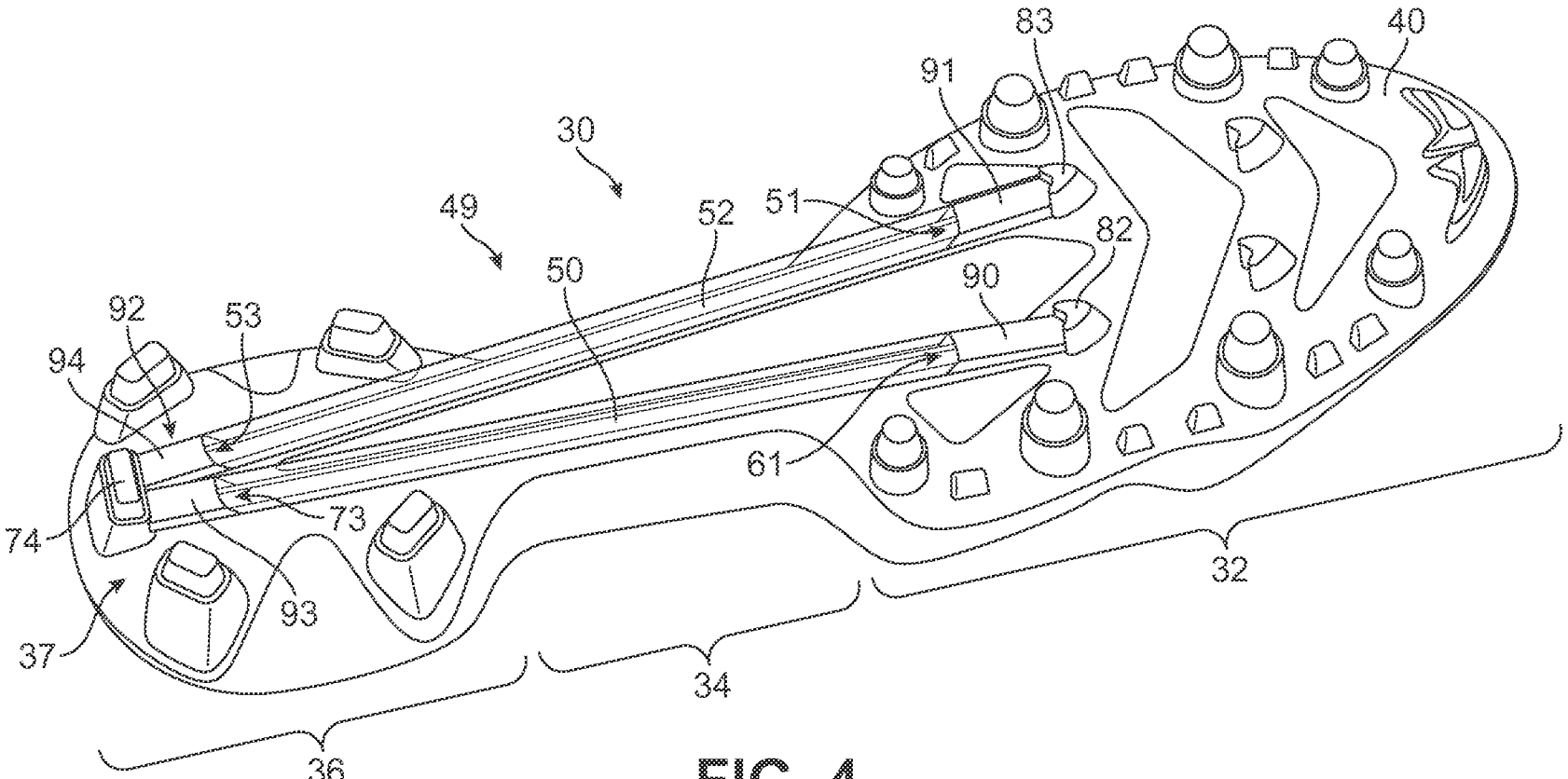
FIG. 4 is an isometric view of the embodiment of FIG. 2.

The details of the reinforcement members are now discussed in further detail with reference to FIG. 4, which illustrates a bottom isometric view of an embodiment of sole structure 30. Referring to FIG. 4, sole structure 30 can further include one or more reinforcement members, including, for example, a first reinforcement member 50 and a second reinforcement member 52. For purposes of clarity, first reinforcement member 50 and second reinforcement member 52 may be collectively referred to as plurality of reinforcement members 49, or simply reinforcement members 49, throughout this detailed description and in the claims.

First reinforcement member 50 may include a forward end 61 and a rearward end 73. Similarly, second reinforcement member 52 may include a forward end 51 and a rearward end 53. Forward end 61 of first reinforcement member 50 and forward end 51 of second reinforcement member 52 may be disposed for example, in forefoot region 32 of the sole structure 30. In addition, rearward end 73 of first reinforcement member 50 and rearward end 53 of second reinforcement member 52 may be located, for example, in the heel region 36 of sole structure 30.

Reinforcement members 49 may be arranged in various orientations with respect to one another to provide different degrees of stiffness and/or stability to the sole structure 30. In one embodiment, reinforcement members 49 may be arranged substantially parallel to one another. In another embodiment, a first reinforcement member 50 and a second reinforcement member 52 can be oriented at an angle to one another, as depicted in FIG. 4. In one such configuration, not shown, forward end 61 of first reinforcement member 50 and forward end 51 of second reinforcement member 52 may be disposed closer to one another than rearward end 73 of first reinforcement member 50 and rearward end 53 of second reinforcement member 52. In another configuration, shown in FIG. 4, rearward end 73 of first reinforcement member 50 and rearward end 53 of second reinforcement member 52 may be disposed closer together than forward end 61 of first reinforcement member 50 and forward end 51 of second reinforcement member 52. In some embodiments, this arrangement provides a V-shaped formation for first reinforcement member 50 and second reinforcement member 52. For example, first reinforcement member 50 and second reinforcement member 52 can be placed further apart in a relatively wide portion of sole structure 30, such as in the forefoot region 32 of the sole structure 30, to provide enhanced stiffness and/or stability.

Figure 5:
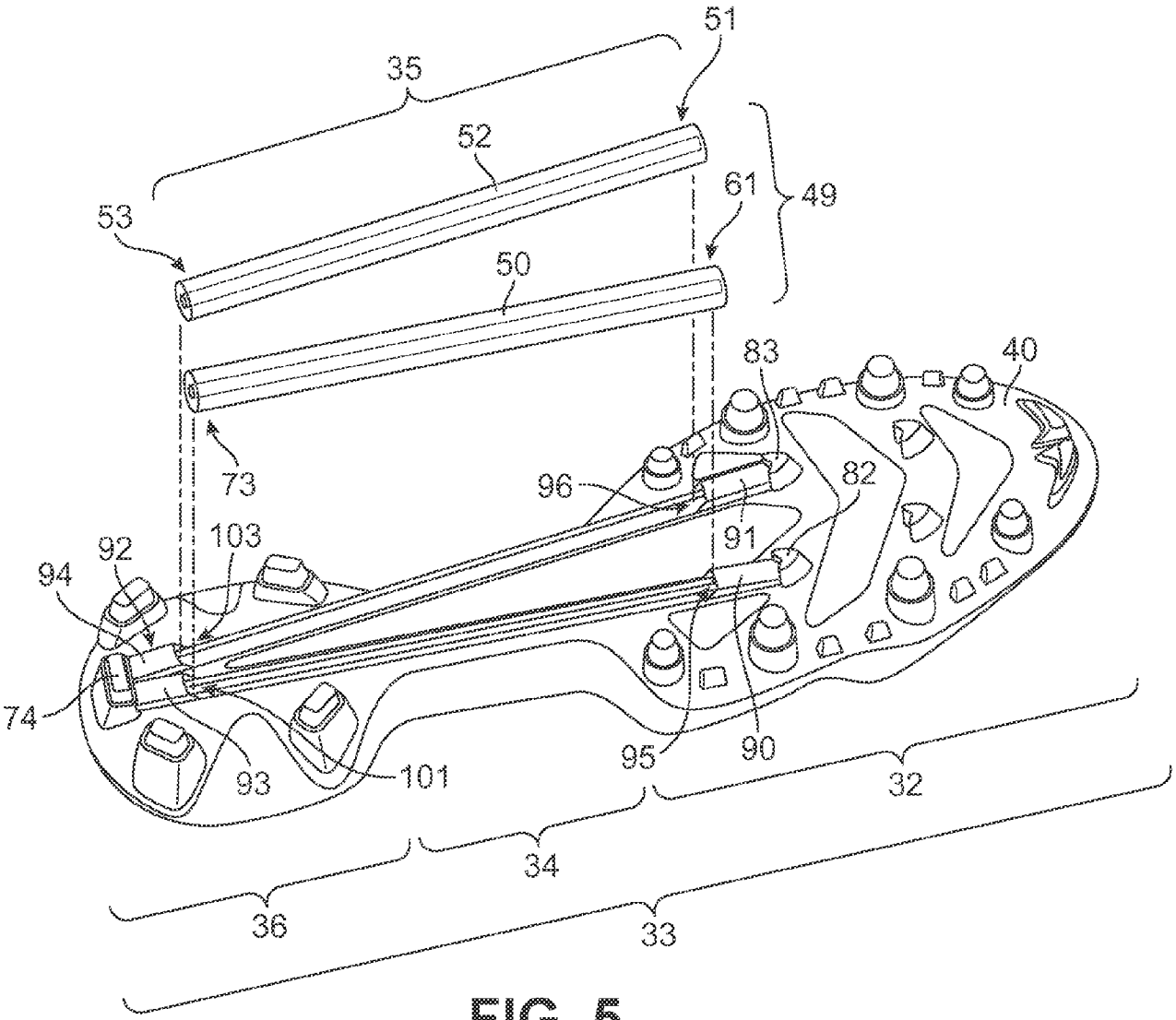
FIG. 5 is an isometric exploded view of an embodiment of an article of footwear.

First reinforcement member 50 and second reinforcement member 52 may generally be elongated elements that can have various cross-sectional shapes. For example, as depicted in the example of FIG. 5, first reinforcement member 50 and second reinforcement member 52 can have a generally round cross-sectional shape. According to other examples, first reinforcement member 50 and second reinforcement member 52 can have other cross-sectional shapes, such as a square shape, a rectangular shape, a generally "U" shaped cross section, a generally "I" shaped cross section, or other cross-sectional shape. In a further example, reinforcement members 49 can be rods having an elongated shape with a generally round cross section.

The dimensions of reinforcement members can be selected to control the stiffness and/or stability provided by reinforcement members to a sole structure. For example, the width or diameter of reinforcement members can be increased to enhance the stiffness and/or stability of reinforcement members by reducing the amount that the reinforcement members bend. According to a further example, the lengths of reinforcement members can be varied to affect which portions of the sole structure are supported by the reinforcement members.

In one embodiment, first reinforcement member 50 and/or second reinforcement member 52 can have any length 35 in the range between approximately 5% and 95% of the total longitudinal length 33 of sole structure 30 (see FIG. 5). In one embodiment, first reinforcement member 50 and/or second reinforcement member 52 can have any length 35 in the range between approximately 50% and 75% of the total longitudinal length 33 of sole structure 30. It will be understood that these particular ranges for the relative length of a reinforcement member are not intended to be limiting and could have any different values in other embodiments.

Moreover, according to an embodiment, first reinforcement member 50 and/or second reinforcement member 52 may have a width or diameter that is between approximately 5-25% of a lateral width of a sole structure. In one embodiment, first reinforcement member 50 and/or second reinforcement member 52 may have a width or diameter in a range between approximately 10-15% of any lateral width of a sole structure. It will be understood that these particular ranges for the relative width and/or diameter of a reinforcement member are not intended to be limiting and could have any different values in other embodiments.

Because the lateral width of the sole structure may vary along a longitudinal length of the sole structure, the lateral width may be selected at any point along the longitudinal length of the sole structure, such as, for example, a widest point of the sole structure or a narrowest point of the sole structure. The dimensions of a reinforcement member may be selected, for example, according to a desired amount of stiffness and/or stability to be provided by the reinforcement member. Moreover, it should be understood that in some embodiments first reinforcement member 50 and second reinforcement member 52 could have substantially similar dimensions. In still other embodiments, however, first reinforcement member 50 and second reinforcement member 52 could have substantially different dimensions. For example, in one embodiment, first reinforcement member 50 could be slightly longer than second reinforcement member 52 in order to apply different degrees of reinforcement over the medial and lateral sides of sole structure 30.

In different embodiments, the rigidity of a reinforcement member relative to a sole structure could vary. In some embodiments, a reinforcement member could be less rigid than a sole structure. In other embodiments, a reinforcement member could have a substantially similar rigidity to a sole structure. In still other embodiments, a reinforcement member could have a substantially greater rigidity than a sole structure. For example, in one embodiment, first reinforcement member 50 and/or second reinforcement member 52 could be substantially more rigid than sole structure 30. This could be accomplished through the use of particular materials and/or by varying the structural geometry of first reinforcement member 50 and/or second reinforcement member 52. The types of materials used and the structural geometry of various reinforcement members are discussed in further detail below.

The positioning of reinforcement members may also be selected to control which portions of a sole structure are supported by the reinforcement members. For example, in the embodiment shown in FIGS. 2-4, reinforcement members 49 can be arranged to extend through the forefoot region 32, the midfoot region 34, and/or the heel region 36. In such arrangements, reinforcement members 49 can enhance the stability and stiffness of the regions which reinforcement members 49 extend across so that there is reduced or minimized bending of those regions. According to an embodiment, first reinforcement member 50 and second reinforcement member 52 may both extend from the midfoot region 34 to the heel region 36 of the sole structure 30. According to another embodiment, first reinforcement member 50 and second reinforcement member 52 can be positioned to extend across all or part of a single portion of sole structure 30, such as, for example, forefoot region 32, midfoot region 34, or heel region 36. Having reinforcement members extend from heel region 36 to forefoot region 32 can provide additional support for the arch portion of a wearer's foot.

Although the embodiment shown in FIG. 4 includes a first reinforcement member 50 and a second reinforcement member 52 extending through the same regions of a sole structure 30, other embodiments could include reinforcement members that extend through different regions. For example, one reinforcement member could extend from the forefoot region to the heel region while another reinforcement member could extend from the midfoot region to the heel region of the sole structure.

In some embodiments, reinforcement members can be associated with ground engaging members. In some embodiments, for example, at least one end of a reinforcement member could be disposed adjacent to a ground engaging member. In some embodiments, at least one end of a reinforcement member could be connected to a ground engaging member. In one embodiment, a reinforcement member could extend between two ground engaging members. Associating an end of a reinforcement member with a ground engaging member may enhance the strength of the ground engaging member. In addition, this arrangement can help strengthen the connection of the end of the reinforcement member to the sole structure. Furthermore, associating ground engaging members with the ends of a reinforcement member could further provide some control over the degree to which the ends of the reinforcement member may penetrate into a ground surface during use.

Reinforcement members can be provided in various configurations relative to ground engaging members. In one embodiment, a reinforcement member can be arranged so that only one end of the reinforcement member is located adjacent to or connected to a ground engaging member. In another embodiment, if a plurality of reinforcement members is provided, the reinforcement members can be arranged relative to ground engaging members in the same manner or the reinforcement members can be arranged in different ways relative to ground engaging members. For example, only one end of a first reinforcement member may be located adjacent to or connected with a ground engaging member, while both ends of a second reinforcement member may be located adjacent to or connected with a ground engaging member.

In one embodiment, in which more than one reinforcement member is provided, the reinforcement members can extend between the same ground engaging members. In another embodiment, reinforcement members can have at least one shared ground engaging member. For example, referring to the embodiments of FIGS. 4 and 5, a first reinforcement member 50 and a second reinforcement member 52 can extend between a same ground engaging member 74 in the heel region 36 of the sole structure 30 and different ground engaging members in the forefoot region 32. In some embodiments, rearward end 73 of first reinforcement member 50 may be disposed adjacent to rear ground engaging member 74 and forward end 61 of first reinforcement member 50 may be disposed adjacent to forefoot ground engaging member 82. Likewise, rearward end 53 of second reinforcement member 52 may be disposed adjacent to rear ground engaging member 74 and forward end 51 of second reinforcement member 52 may be disposed adjacent to ground engaging member 83. In some embodiments, rear ground engaging member 74 can be located in the rear of the heel region 36 of sole structure 30. In some embodiments, rear ground engaging portion 74 may further be disposed on a rear of peripheral portion 37 of sole structure 30.

A reinforcement member can be secured to sole structure 30 in various ways. In one embodiment, a reinforcement member can be secured directly to outsole 40 of sole structure 30. In another embodiment, a reinforcement member can be secured to sole structure 30 via a mounting member which secures the reinforcement member in place relative to outsole 40. In some embodiments, a mounting member could be a stand-alone feature of outsole 40, which is primarily attached to an outer surface of outsole 40. In other embodiments, a mounting member could be associated with another feature of outsole 40, such as a ground engaging member. For example, a mounting member can be provided as an integral part of a ground engaging member so that a reinforcement member is connected directly to the ground engaging member.

As shown in the example of FIG. 4, forward end 61 of first reinforcement member 50 and forward end 51 of second reinforcement member 52 can be secured to outsole 40 via a first forefoot mounting member 90 and a second forefoot mounting member 91, respectively. In some embodiments, first forefoot mounting member 90 may be disposed adjacent to second inner forefoot ground engaging member 82. In some embodiments, second forefoot mounting member 91 may be disposed adjacent to third inner forefoot ground engaging member 83. In addition, rearward end 73 of first reinforcement member 50 and rearward end 53 of second reinforcement member 52 may be secured to outsole 40 using rear heel mounting member 92. In some embodiments, rear heel mounting member 92 may be disposed adjacent to rear ground engaging member 74. In such an example, first reinforcement member 50 and second reinforcement member 52 extend between forefoot region 32 and heel region 36 of sole structure 30. As a result, the reinforcement members may enhance the stiffness and stability of the forefoot, midfoot, and/or heel region, and in turn provide enhanced support for the arch of a wearer's foot.

As previously discussed, a mounting member could be attached to and/or integrally formed with a ground engaging member. In the embodiment shown in FIG. 4, each of first forefoot mounting member 90 and second forefoot mounting member 91 may be integrally formed with second inner forefoot ground engaging member 82 and third inner forefoot ground engaging member 83, respectively. Additionally, in some embodiments, rear heel mounting member 92 may be integrally formed with rear ground engaging member 74. In other embodiments, however, first forefoot mounting member 90, second forefoot mounting member 91, and rear heel mounting member 92 could be separated from second inner forefoot ground engaging member 82, third inner forefoot ground engaging member 83, and rear ground engaging member 74, respectively. In still other embodiments, some mounting members may be integrally formed with an adjacent ground engaging member, while other mounting members could be separated from an adjacent ground engaging member.

Mounting members for reinforcement members can be provided in various shapes and geometries. For example, in some embodiments, first forefoot mounting member 90 may be approximately sized and shaped to receive forward end 61 of first reinforcement member 50. In some embodiments, second forefoot mounting member 91 may be approximately sized and shaped to receive forward end 51 of second reinforcement member 52, respectively. Moreover, in some embodiments, rear heel mounting member 92 could be sized and configured to receive both rearward end 73 of first reinforcement member 50 and rearward end 53 of second reinforcement member 52, respectively. In some embodiments, for example, rear heel mounting member 92 can include first mounting portion 93 and second mounting portion 94 that are configured to receive rearward end 73 and rearward end 53, respectively.

A mounting member for a reinforcement member can include a receiving cavity for receiving an end of a reinforcement member so that the reinforcement member is received within the mounting member and secured in place relative to the outsole. In one embodiment, a mounting portion can include a single receiving cavity to receive a single end of a reinforcement member. In another embodiment, a mounting portion can include more than one receiving cavity for receiving multiple ends of reinforcement members.

FIG. 5 depicts an exploded view of an embodiment of a sole structure 30, such that first reinforcement member 50 and second reinforcement member 52 are removed from their respective mounting members. In some embodiments, first reinforcement member 50 and second reinforcement member 52 may be connected to first forefoot mounting member 90 and second forefoot mounting member 91 in forefoot region 32. First reinforcement member 50 and second reinforcement member 52 may also be connected to rear heel mounting member 92 in heel region 36. As shown in the example of FIG. 5, first forefoot mounting member 90 can include a receiving cavity 95 to receive forward end 61 of first reinforcement member 50. Additionally, second forefoot mounting member 91 can include a receiving cavity 96 to receive forward end 71 of second reinforcement member 52. In some embodiments, the single rear heel mounting member 92 can include multiple receiving cavities, such as a lateral receiving cavity 101 and a medial receiving cavity 103. In some embodiments, lateral receiving cavity 101 may be configured to receive rearward end 73 of first reinforcement member 50 while medial receiving cavity 103 may be configured to receive rearward end 53 of second reinforcement member 52. Thus, a mounting member can be configured to receive one reinforcement member 30, as in the examples of the first forefoot mounting member 90 and the second forefoot mounting member 91 in FIG. 5. Additionally, a mounting member can be configured to receive more than one reinforcement member, as in the example of rear heel mounting member 92 in FIG. 5.

Generally, the method of joining a reinforcement member with associated mounting members can vary from one embodiment of another. According to one embodiment, a reinforcement member can be inserted into one or more mounting members after outsole 40 of sole structure 30 has been manufactured. For example, outsole 40 can be first molded and then the reinforcement member can be bent so it may be inserted into the receiving cavities of one or more respective mounting members. According to another embodiment, a reinforcement member can be connected to one or more mounting members during the outsole manufacturing process. For example, a reinforcement member 50 can be placed within a mold or die and formed within one or more preexisting mounting members of outsole 40. However, it will be understood that the means by which a reinforcement member is joined with a mounting member could be accomplished using any other method and is not limited to the exemplary methods described here.

A reinforcement member can be provided with various constructions. According to an embodiment, a reinforcement member can be provided with a single-piece construction. For example, in some embodiments, a reinforcement member may be made of a single material. Such a reinforcement member made from a single material may have a single-piece construction. According to another embodiment, a reinforcement member can be formed of more than one material. For example, some embodiments can comprise reinforcements having two distinct components with differing material properties. Such a reinforcement member could have a two-piece construction.

Figure 6:
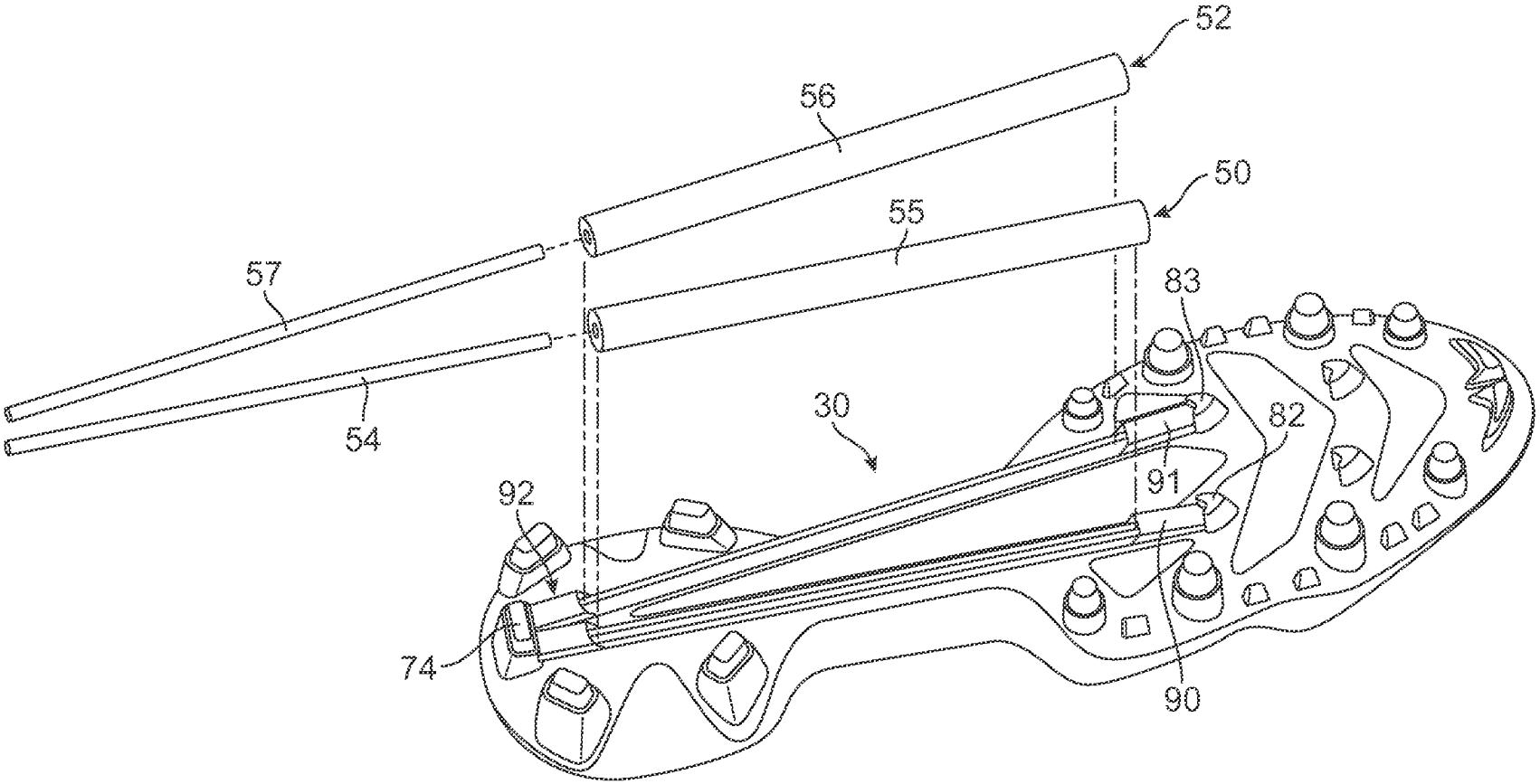
FIG. 6 is an isometric exploded view the embodiment of FIG. 5.

FIG. 6 illustrates an isometric exploded view of the embodiment of FIG. 5 to clearly show the two piece construction of reinforcement members 49. According to one example, a first reinforcement member 50 may include an outer portion 55 and an inner portion 54. In addition, a second reinforcement member 52 can be formed with an outer portion 56 and an inner portion 57. As seen in FIG. 6, inner portion 54 and inner portion 57 may be disposed within, or otherwise covered by, outer portion 55 and outer portion 56, respectively.

A reinforcement member can include two or more portions that have different material properties. For example, a reinforcement member can include different materials that have different stiffness or modulus of bending values. As another example, a reinforcement member can include different materials having different appearances. In one embodiment, outer portion 56 and inner portion 57 of a first reinforcement member 50 can be made of different materials that have different stiffness or modulus of bending values. In some embodiments, inner portion 54 and inner portion 57 may be substantially less rigid than outer portion 55 and outer portion 56, respectively. In an exemplary embodiment, inner portion 54 and inner portion 57 may be substantially more rigid than outer portion 55 and outer portion 56, respectively.

Inner portion 54 and inner portion 57 may be, for example, formed from carbon fiber. Carbon fiber used herein may have a flexural modulus of, for example, approximately 100 $kN/mm^2$ to approximately 500 $kN/mm^2$. The modulus of elasticity of carbon fiber may have similar values to the flexural modulus. Outer portion 55 and outer portion 56 may be made of, for example, TPU. TPU used herein may have a flexural modulus of, for example, approximately 1 $N/mm^2$ to approximately 500 $N/mm^2$. The modulus of elasticity of TPU may have similar values to the flexural modulus. Outer portion 55 and outer portion 56 may respectively provide outer coverings for inner portion 54 and inner portion 57. In some cases, outer portion 55 and outer portion 56 can provide a degree of protection to inner portion 54 and inner portion 57 from environmental damage, such as a direct physical impact to inner portion 54 and inner portion 57. A reinforcement member may have a flexural modulus of, for example, approximately 0.70 $kN/mm^2$ to approximately 500 $kN/mm^2$. In another example, a reinforcement member may have a flexural modulus of, for example, approximately 0.80 $kN/mm^2$ to approximately 100 $kN/mm^2$. The modulus of elasticity of the reinforcement member may have a similar value to flexural modulus.

In some embodiments, the average rigidity of first reinforcement member 50 and/or second reinforcement member 52 may be substantially different than the average rigidity of sole structure 30. In some embodiments, the average rigidity of first reinforcement member 50 and/or second reinforcement member 52 may be substantially greater than the average rigidity of sole structure 30. By using reinforcement members that are substantially stiffer than the sole structure, the reinforcement members can help reduce the tendency of the sole structure to bend or otherwise deform in the regions where the reinforcement members are located, which can increase stability for a wearer. It will therefore be understood that in selecting a desired flexural modulus for one or more reinforcement members, the flexural modulus or other rigidity characteristics of the sole structure may be considered.

The geometrical shape of the component parts of a reinforcement member may vary. In some embodiments, an inner member and an outer member could have corresponding geometric shapes. For example, as seen in FIG. 6, outer member 55 of first reinforcement member 50 has a hollow tube-like geometry that is configured to house the rod-like geometry of inner member 54. In other embodiments, the geometry of an inner portion and an outer portion may not correspond to or otherwise coincide with one another.

Various methods may be utilized to produce a reinforcement member made of more than one material. According to an embodiment, a first reinforcement member 50 can be produced by overmolding outer member 55 onto inner member 54. For example, carbon fibers can be pulltruded through a bath of a plastic material, such as TPU, to provide a first reinforcement member 50 which includes an inner member 54 of carbon fiber covered at least in part by an outer member 55 of plastic. In some embodiments, a plastic material for the outer member 55 may be a transparent plastic material so that inner member 54 may be visible through outer member 55. For example, when inner member 54 has been painted or colored a transparent or translucent outer member 55 may be desirable to permit viewing of inner member 54.

According to an embodiment, a reinforcement member can be tailored for different uses and activities so that the reinforcement member provides a degree of stiffness and/or stability suitable for each different activity. For example, if an activity or use requires a relatively large amount of stiffness and stability, a material for the reinforcement can be selected to provide the desired stiffness and/or stability. For example, materials could be selected which exhibit relatively large moduli of bending. Conversely, if an activity or use requires less stability and/or stiffness, materials for a reinforcement member can be selected to provide less stiffness and stability.

It will be understood that in embodiments comprising two or more reinforcement members, the different reinforcement members need not comprise similar materials. In some embodiments, for example, one reinforcement member may be made of substantially different materials than another reinforcement member. Moreover, in some embodiments, one reinforcement member may have a single-piece construction, while a second reinforcement member has a two-piece construction. However, in still other embodiments, two or more reinforcement members of a sole structure could be made of substantially similar materials. By independently varying the number and type of materials used for each reinforcement member, the properties of a sole structure could be tuned to achieve desired levels of stiffness and/or stability.

According to an embodiment, a reinforcement member of a sole structure 30 can be removable so that the reinforcement member may be interchanged with another reinforcement member. Such an arrangement may permit the stiffness and stability of the sole structure 30 to be tailored to specific activities or uses. For example, the properties provided by a reinforcement member can be varied by replacing a reinforcement member with another reinforcement member having different properties. In one embodiment, stiffness or rigidity of a reinforcement member can be varied by replacing a reinforcement member with another having greater stiffness or rigidity. According to an embodiment, a reinforcement member can be removed from a sole structure 30 by removing the reinforcement member from a pair of mounting members that fasten the reinforcement member to the sole structure 30. Once the original reinforcement member has been removed from sole structure 30, another reinforcement member having a different stiffness could be attached to sole structure 30. Such interchanging of reinforcement members can be accomplished by a user of an article of footwear or by a service professional trained to remove the reinforcement members.

According to an embodiment, a manufacturer may make an article of footwear 10 having a general sole structure 30 design which can have various uses and purposes. Such a general sole structure 30 design could then be further tailored to each of the various uses and purposes by selecting one or more particular reinforcement members having a particular stiffness suitable for a desired use. Such reinforcement members selected by a manufacturer may be removable and interchangeable by a user or practitioner, as discussed above, or may be fixed in place by the manufacturing process. Using a general design for an article of footwear and then further modifying the article of footwear for a particular use or purpose can reduce manufacturing costs by requiring fewer article of footwear designs.

A reinforcement member of a sole structure can be positioned on outsole 40 to enhance stiffness and/or stability of sole structure. In particular, a desired stiffness and/or stability could be achieved by tuning the geometry of reinforcement members in relation to the outsole 40. Such positioning can be accomplished in various manners. For example, a reinforcement member may be oriented relative to, or along, a longitudinal, or lengthwise, axis of an outsole. In other embodiments, a reinforcement member could be oriented along a lateral, or widthwise, axis of an outsole.

Figure 7:
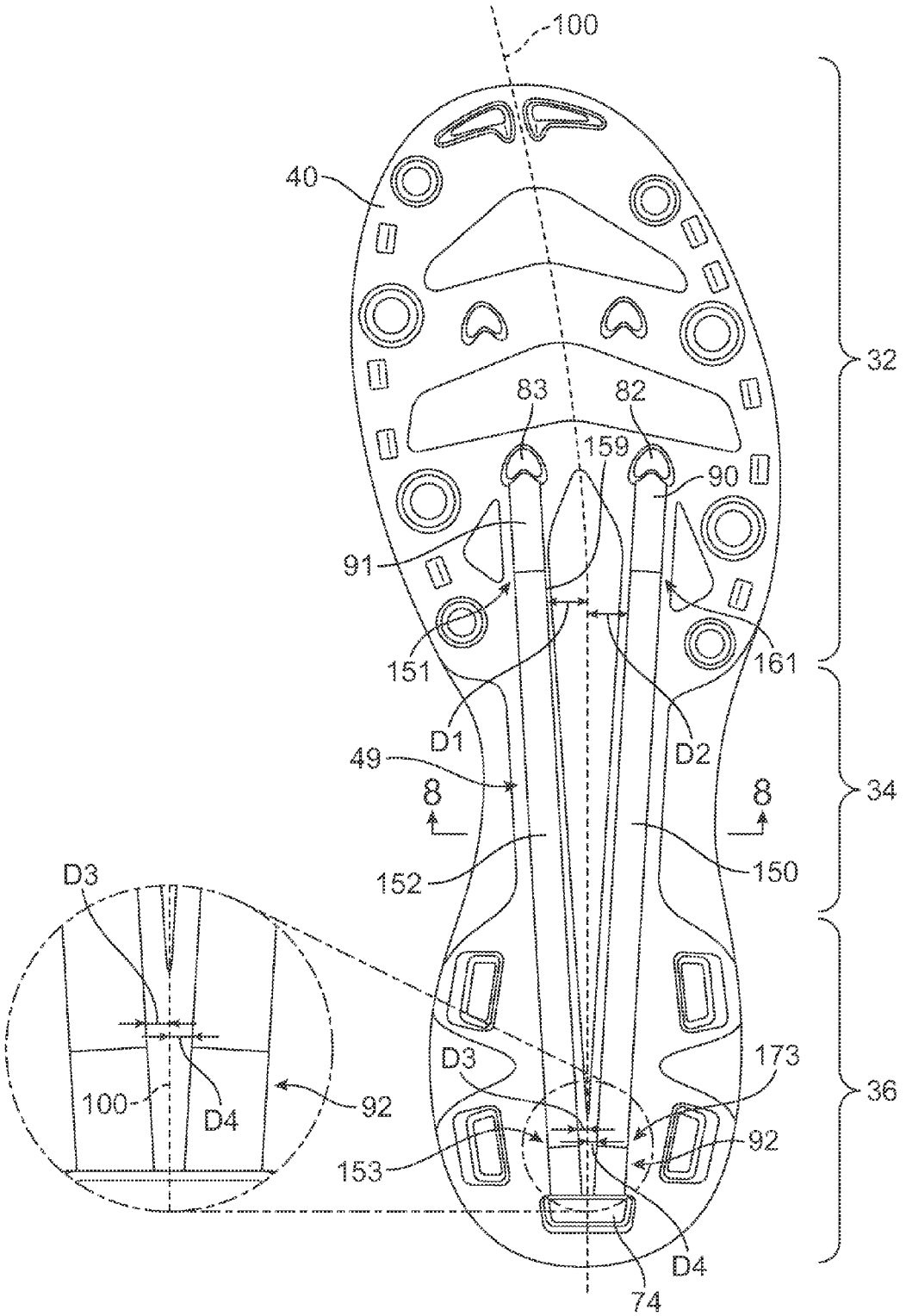
FIG. 7 is a bottom view of an embodiment of an article of footwear.

FIG. 7 illustrates a bottom view of an embodiment of sole structure 30 that clearly shows the relative orientations of reinforcement members on outsole 40. In addition, FIG. 7 (along with the corresponding cross-section in FIG. 8) illustrates an embodiment that incorporates single-piece constructions for first reinforcement member 150 and second reinforcement member 152.

According to an embodiment, a reinforcement member can be oriented generally lengthwise from forefoot region 32 to heel region 36 of an outsole 40. For example, as shown in the embodiment of FIG. 7, first reinforcement member 150 and second reinforcement member 152 can be placed relative to a centerline 100 of an outsole 40. As shown in the example of FIG. 7, the centerline 100 may be curved according to the shape of the outsole 40 and the natural curvature of a user's foot. In some embodiments, first reinforcement member 150 and second reinforcement member 152 can be arranged to extend between forefoot portion 32 and heel portion 36 of outsole 40. As shown in the example of FIG. 7, forward end 161 of first reinforcement member 150 and forward end 151 of second reinforcement member 152 may be located in forefoot region 32, while rearward end 73 of first reinforcement member 150 and rearward end 53 of second reinforcement member 152 may be located in heel region 36 of the outsole 40.

According to an embodiment, a reinforcement member can be oriented at an angle relative to a longitudinal axis or centerline of an outsole 40. Such an arrangement can be provided to enhance the stiffness and/or stability of particular portions of the outsole 40 where a reinforcement member is located. When more than one reinforcement member is provided, the reinforcement members may be angled relative to one another. For instance, reinforcement members may be angled so that the reinforcement members are spaced apart in a relatively wide portion of an outsole to provide enhanced stiffness and/or stability over a greater area. For example, forward end 161 of first reinforcement member 150 can be located, for example, a distance D2 from the centerline 100 and forward end 151 of second reinforcement member 152 can be located, for example, a distance D1 from the centerline 100. In some embodiments, distance D1 and distance D2 can be substantially similar. In other embodiments, distance D1 and distance D2 could be substantially different. Distance D1 and distance D2 can be in the range of, for example, approximately 0 to 10% of a lateral width of a sole structure. Such an arrangement can be provided to enhance the stiffness and/or stability of the sole structure 30 over a greater area due to the space provided between forward end 151 and forward end 161 and the centerline 100. Such an arrangement can be provided, for example, in the forefoot region 32 of a sole structure 30 where a user's foot is relatively wide in comparison to other portions of a user's foot and greater support and stiffness and/or stability may be desired over this area.

According to an embodiment, the distance between the ends of reinforcement members can be relatively close together. Such an arrangement can be used, for example, in a relatively narrow region of a sole structure 30 or where a concentrated area of enhanced stiffness and/or stability is desired. As shown in the example of FIG. 7, rearward end 173 of first reinforcement member 150 and rearward end 153 of second reinforcement member 152 can be located in heel region 36 of a sole structure 30. Rearward end 173 of first reinforcement member 150 may be located a distance D4 from the centerline and rearward end 153 of second reinforcement member 152 may be located a distance D3 from the centerline 100, as shown in the example of FIG. 7. In another embodiment, rearward end 173 of first reinforcement member 150 and rearward end 153 of second reinforcement member 152 can intersect and be located on the centerline 100. In some embodiments, distance D3 and distance D4 can be substantially similar. In other embodiments, distance D3 and distance D4 can be substantially different. In some embodiments, distance D3 and distance D4 can be in the range of, for example, approximately 0 to 5% of a lateral width of a sole structure.

A distance between an end of a reinforcement member and a centerline 100 can be determined, for example, by measuring a distance from the centerline 100 of a sole structure 30 to a portion of a reinforcement member. For example, distance D1 may be measured as an approximate distance between an inward edge 159 of forward end portion 151 and centerline 100. However, in other embodiments, distance D1 could be measured between any other portion of second reinforcement member 152 and centerline 100. Moreover, the distance from centerline 100 to second reinforcement member 152 may be taken at any location along the width of second reinforcement member 152. Such measurements to determine a distance from an end of a reinforcement member to a centerline can be made, for example, at the point where the end of reinforcement member engages a mounting member. According to another example, a measurement to determine a distance between an end of a reinforcement member and a centerline can be made a distance from a distal tip or end of a reinforcement member, or from the point where the reinforcement member engages a mounting member. According to a further example, such a measurement is not made more than a distance, which is equal to approximately 10% or less of a length of a reinforcement member, from the distal tip or point where the end of reinforcement member engages a mounting member. It will be understood that distance D2, distance D3 and distance D4 could likewise be determined in a substantially similar manner.

According to an embodiment, distance D2 from the forward end 161 of first reinforcement member 150 to the centerline 100 may be greater than a distance D4 of rearward end 173 of first reinforcement member 150 from centerline 100. Additionally, distance D1 from forward end 151 of second reinforcement member 152 to centerline 100 may be greater than distance D3 of rearward end 153 of second reinforcement member 152 from centerline 100. For example, the distance D1 and distance D2 can each be a non-zero number which is greater than each of distance D3 and distance D4. According to another example, distance D1 and distance D2 can be a non-zero number while the distance D3 and distance D4 can be approximately zero.

Figure 8:
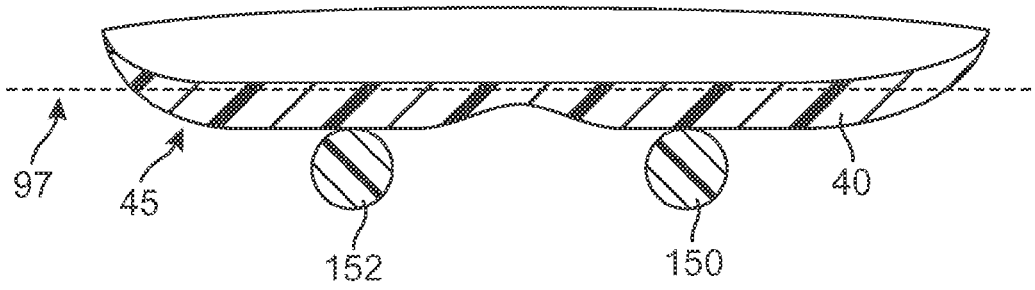
FIG. 8 is a cross-sectional view through line 8-8 of FIG. 7.

The geometry and location of reinforcement members can also be used to enhance the stiffness and/or stability of a sole structure 30. As shown in the example of FIG. 8, which is a cross-sectional view along line 8-8 in FIG. 7, first reinforcement member 150 and second reinforcement member 152 may be located externally to outsole 40 of sole structure 30. Such an arrangement results in first reinforcement member 150 and second reinforcement member 152 being located a distance from a neutral axis 97 of the sole structure 30. The neutral axis 97 may be produced when the sole structure 30 is bent, such as when a user bends an article of footwear 10 due to taking a step, or other uses. Such a geometry may increase the stiffness and stability of sole structure 30 due to the distance that first reinforcement member 150 and second reinforcement member 152 are located from neutral axis 97 during bending.

According to an embodiment, a reinforcement member may be in contact with the outermost bottom surface 45 of the outsole 40, such that the reinforcement member contacts outer most bottom surface 45 of the outsole 40 along a portion or substantially all of the entire length of reinforcement member. According to an embodiment, a reinforcement member can contact the outermost bottom surface of outsole 40 at the both ends of reinforcement member 150. According to another embodiment, a reinforcement member can be spaced apart from the outermost bottom surface of the outsole 40 that faces a ground surface so that a non-zero distance is provided between the reinforcement member and the outermost bottom surface of the outsole 40. By spacing a reinforcement member from the outermost bottom surface 45 of an outsole 40, the distance between the reinforcement member and neutral axis 97 may be increased to enhance the stiffness and/or stability of outsole 40. Such an arrangement can be provided, for example, by configuring the connecting of a reinforcement member to outsole 40 so that the reinforcement member is held and spaced at a distance from outsole 40.

According to an embodiment, a reinforcement member can have any desired cross-sectional shape(s). Generally, a reinforcement member can have any cross-sectional shape including, but not limited to: round, circular, oval, square, rectangular, triangular, regular, irregular or any other kind of cross-sectional shape. The cross-sectional shape can be selected to provide a desired stiffness, bending resistance, resiliency, force reflection or other desired physical property. If a non-circular cross-sectional shape is selected, that shape may be oriented to provide a desired physical property in a particular direction or line of action. As shown in FIG. 8, first reinforcement member 150 and second reinforcement member 152 can each have a generally round cross-sectional shape formed by a single material. Such a round cross-sectional shape may increase the toughness of a reinforcement member by reducing or eliminating sharp edges or corners which could become regions of high stress during bending.

Figure 9:
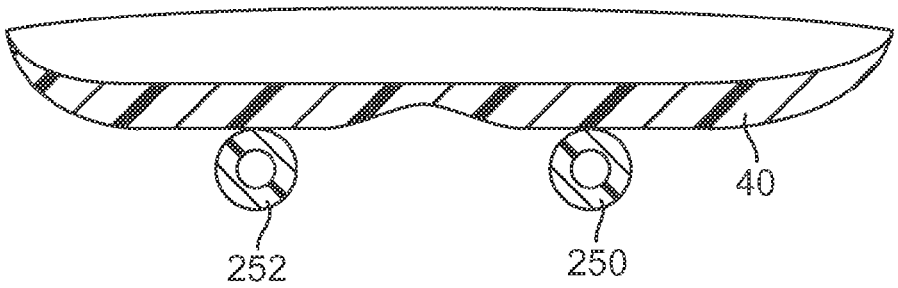
FIG. 9 is a cross-sectional view of an article of footwear, according to an embodiment.

FIG. 9 depicts a cross-sectional view of an article of footwear including a first reinforcement member 250 and a second reinforcement member 252 having generally round cross-sectional shapes that are hollow. Such cross-sectional shapes could be used to provide reinforcement members that enhance the stiffness and/or stability of a sole structure 30 but require less material due to the hollow center of the reinforcement members. Such hollow cross-sectional shapes can also be used to accommodate one or more other materials within a reinforcement member, such as in the example shown in FIG. 5 and FIG. 6.

Figure 10:
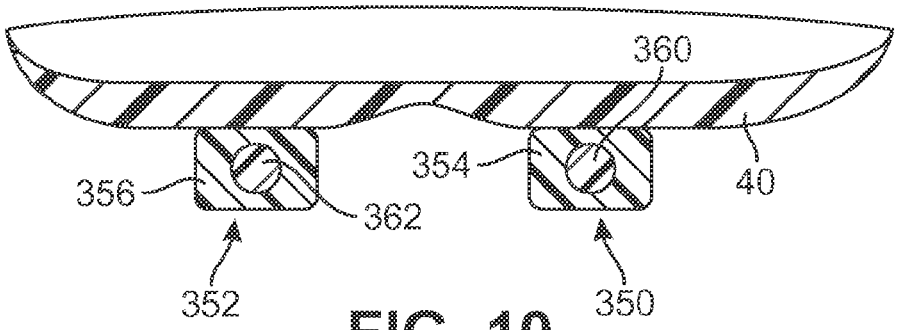
FIG. 10 is a cross-sectional view of an article of footwear, according to an embodiment.

FIG. 10 depicts a cross-sectional view of an article of footwear including first reinforcement member 350 and second reinforcement member 352 having rectangular cross-sectional shapes for outer portion 354 and outer portion 356, respectively. In this embodiment, first reinforcement member 350 and second reinforcement member 352 may further include rounded inner portion 360 and rounded portion 362, respectively. Such cross-sectional shapes for the outer portion of each reinforcement member can be further increase stiffness and stability.

Figure 11:
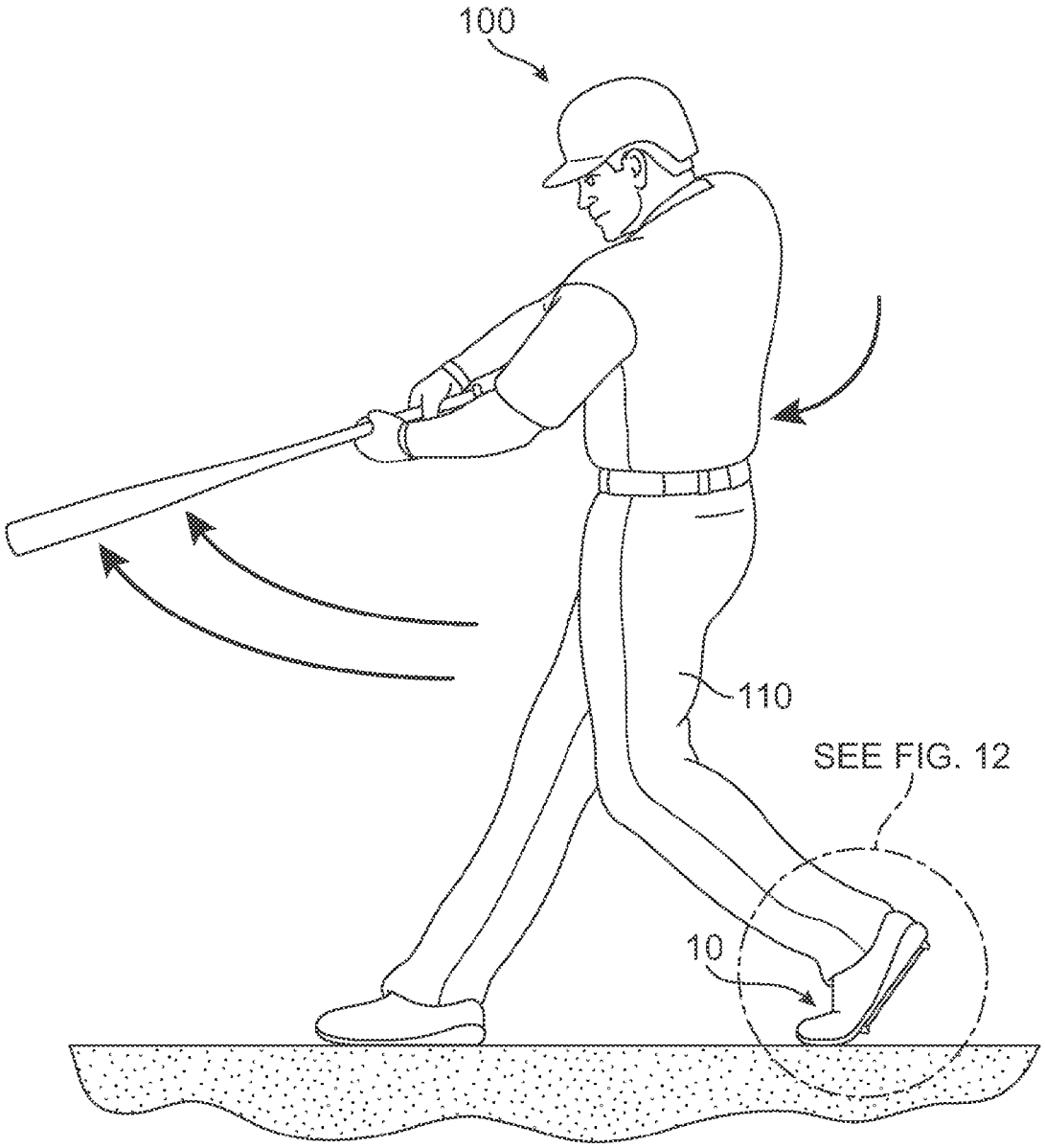
FIG. 11 is a side view of a person swinging a bat and the configuration of an article of footwear during the swing, according to an embodiment.

FIG. 11 is a side view depicting an example of a person swinging a bat while wearing an article of footwear 10 according to any of the embodiments described herein. During the swinging motion, the person may plant their back leg 110 and pivot on the foot of the back leg 110, which can cause the article of footwear to flex and bend, as shown in further detail in FIG. 12.

Figure 12:
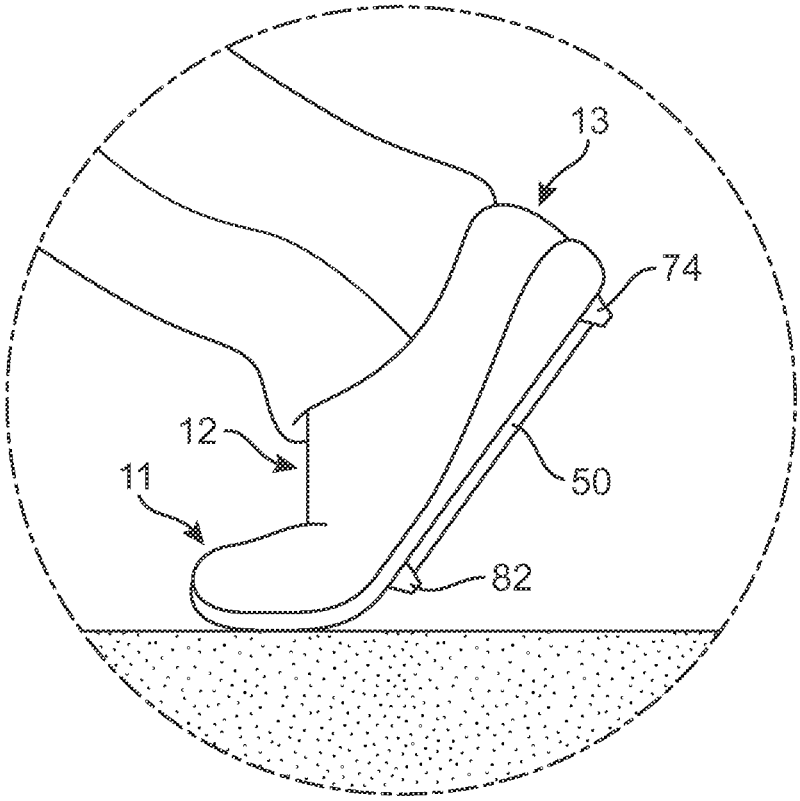
FIG. 12 is an enlarged view of the article of footwear of FIG. 11.

FIG. 12 is an enlarged view of article of footwear 10 of FIG. 11, which shows that due to the swinging motion of the person swinging the bat, the article of footwear 10 has been bent. Under such a condition, at least a portion of the forefoot portion 11 is planted on a ground surface and bent relative to a midfoot portion 12 and a heel portion 13 of the article of footwear 10. However, because the article of footwear 10 includes at least one reinforcement member 50, the stiffness and/or stability of at least the midfoot portion 12 and the heel portion 13 have been enhanced. This configuration may advantageously provide enhanced support and stability for the arch region of a user's foot during the user's motion to swing a bat.

Although the example shown in FIGS. 11 and 12 indicate that a reinforcement member 50 extends across a midfoot portion 12 and a heel portion 13 of an article of footwear 10, the reinforcement member 50 can extend across other portions of the article of footwear 10 in different embodiments. For example, the reinforcement member 50 may extend to at least a portion of the forefoot portion 11 to enhance stiffness in the forefoot portion 11 as well.

According to an embodiment, the length of a reinforcement member can be selected to correspond to the flexion of a user's foot, or at least a portion of the flexion of a user's foot, during various activities. For example, the length of a reinforcement member 50 can be selected to correspond to the flexion of a user's foot during the swinging of a bat, as shown in FIGS. 11 and 12. Such a reinforcement member may provide enhanced stiffness and stability for at least part of those portions of an article of footwear 10 and a user's foot which are not in contact with a ground surface during the motion, while permitting a portion of a user's foot which is contact with a ground surface to bend freely and not be restricted by reinforcement member 50. In addition, the locations of mounting members connecting a reinforcement member to an outsole 40 can be selected to affect the stiffness and/or stability of an article of footwear 10. For example, mounting members can be placed at boundaries of those portions of an outsole to be supported by a reinforcement member.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear including a sole structure, the sole structure comprising:
- an outsole including:
  - a first ground engaging member disposed in a forefoot region of the outsole;
  - a second ground engaging member in a heel region of the outsole;
- a first reinforcement member having:
  - a forward end; and
  - a rearward end opposite the forward end;
- a first mounting member located in the forefoot region of the outsole adjacent to the first ground engaging member and having:
  - a first receiving cavity configured to receive the forward end of the first reinforcement member to connect the first reinforcement member to the outsole;
- a second mounting member located in the heel region of the outsole adjacent to the second ground engaging member and having:
  - a second receiving cavity configured to receive the rearward end of the first reinforcement member to connect the first reinforcement member to the outsole;
- wherein the first reinforcement member extends between the first mounting member and the second mounting member.

2. The article of footwear according to claim 1, further comprising:
- a second reinforcement member having a forward end and a rearward end opposite the forward end; and
- a third mounting member located in the forefoot region of the outsole and having:
  - a third receiving cavity configured to receive the forward end of the second reinforcement member to connect the second reinforcement member to the outsole.

3. The article of footwear according to claim 2, wherein the forward ends of the first and second reinforcement members are located a distance from a centerline of the outsole which is greater than a distance that the rearward ends of the first and second reinforcement members are located from the centerline of the outsole.

4. The article of footwear according to claim 3, wherein the distance the forward ends of the first and second reinforcement members are located from the centerline is approximately 0-10% of a lateral width of the sole structure.

5. The article of footwear according to claim 4, wherein the distance the forward ends of the first and second reinforcement members are located from the centerline is determined within a distance from a distal tip or point where the forward end of one of the first and second reinforcement members engages the first mounting member,
- wherein the distance is equal to approximately 10% or less of a length of the one reinforcement member.

6. The article of footwear according to claim 4, wherein the distance the rearward ends of the first and second reinforcement members are located from the centerline is approximately 0-10% of a lateral width of the sole structure.

7. The article of footwear according to claim 2, wherein the first mounting member is integrally formed with the first ground engaging member.

8. The article of footwear according to claim 7, wherein the second mounting member is integrally formed with the second ground engaging member.

9. The article of footwear according to claim 8, further comprising:
- a second reinforcement member having a forward end and a rearward end opposite the forward end.

10. The article of footwear according to claim 9, further comprising:
- a third mounting member integrally formed with the second ground engaging member of the plurality of ground engaging members, the third mounting member having:
  - a third receiving cavity configured to receive the rearward end of the second reinforcement member.

11. The article of footwear according to claim 1, wherein the first reinforcement member comprises:
- a hollow tube; and
- a rod extending through a length of the hollow tube.

12. The article of footwear according to claim 1, wherein the first reinforcement member is removably connected to the outsole by the first mounting member and the second mounting member, and is interchangeable with another reinforcement member having a different stiffness.

13. The article of footwear according to claim 12, wherein the tube of the first reinforcement member has a generally round cross-sectional shape.

14. The article of footwear according to claim 12, wherein the tube of the first reinforcement member has a generally rectangular cross-sectional shape.

15. The article of footwear according to claim 1, wherein the second ground engaging member is disposed along a centerline of the outsole.

16. The article of footwear according to claim 15, wherein the second mounting member is disposed adjacent to the third mounting member.

17. The article of footwear according to claim 1, wherein the first reinforcement member has a length of 5-95% of a total length of the sole structure.

18. The article of footwear according to claim 1, wherein the first reinforcement member has a width of 5-25% of a lateral width of the sole structure.

19. An article of footwear having a sole structure, the sole structure comprising:
- an outsole including:
  - a first ground engaging member disposed in a forefoot region of the outsole;
  - a second ground engaging member disposed in the forefoot region of the outsole and spaced laterally from the first ground engaging member; and
  - a third ground engaging member disposed in a heel region of the outsole and aligned with a centerline of the outsole;

a first reinforcement member having:

a forward end disposed adjacent to the first ground engaging member; and a rearward end opposite the forward end and disposed adjacent to the third ground engaging member, wherein the first reinforcement member extends between the forward end and the rearward end;

a second reinforcement member having:

a forward end disposed adjacent to the second ground engaging member; and a rearward end opposite the forward end and disposed adjacent to the third ground engaging member, wherein the second reinforcement member extends between the forward end and the rearward end;

a first mounting member located in the heel region of the outsole and having:

a first receiving cavity configured to receive the rearward end of the first reinforcement member; and a second mounting member located in the heel region of the outsole and having:

a second receiving cavity configured to receive the rearward end of the second reinforcement member, wherein the first mounting member and the second mounting member are both integrally formed with the third ground engaging member.

20. The article of footwear according to claim 19, wherein the forward ends of the first and second reinforcement members are located a distance from a centerline of the outsole which is greater than a distance that the rearward ends of the first and second reinforcement members are located from the centerline of the outsole.

21. The article of footwear according to claim 19, wherein the third ground engaging member is located in a rear portion of the heel region.

22. The article of footwear according to claim 19, wherein the third ground engaging member is located on an outer periphery of the outsole and is located in the rear of the outer periphery.

23. The article of footwear according to claim 19, further comprising:

a third mounting member located in the forefoot region of the outsole and having:

a third receiving cavity configured to receive the forward end of the first reinforcement member; and a fourth mounting member located in the forefoot region of the outsole and having:

a fourth receiving cavity configured to receive the forward end of the second reinforcement member.

24. The article of footwear according to claim 19, wherein the third mounting member is integrally formed with the first ground engaging member and the fourth mounting member is integrally formed with the second ground engaging member.

* * * * *